United States Patent [19]

Saunders et al.

[11] Patent Number: 4,805,869

[45] Date of Patent: Feb. 21, 1989

[54] APPARATUS FOR MANUFACTURING OF TAPE DISPENSER

[75] Inventors: Craig M. Saunders, Sagamore Hills; John R. Nottingham, Moreland Hills, both of Ohio

[73] Assignee: Manco, Inc., Cleveland, Ohio

[21] Appl. No.: 65,423

[22] Filed: Jun. 23, 1987

Related U.S. Application Data

[63] Continuation-in-part of Ser. No. 47,936, May 8, 1987.

[51] Int. Cl.[4] ..... B41B 11/62

[52] U.S. Cl. ..... 249/67; 249/102; 264/297.2; 425/190; 425/444

[58] Field of Search ..... 264/297.2, 328.1; 425/190, 192 R, 195, 444; 249/102, 67, 68, 103, 104

[56] References Cited

U.S. PATENT DOCUMENTS

| | | | |
|---|---|---|---|
| D. 118,629 | 1/1940 | Reinecke . | |
| D. 125,085 | 2/1941 | Jackson . | |
| D. 144,214 | 3/1946 | Preble, Jr. | D74/1 |
| D. 144,392 | 4/1946 | Krueger | D74/1 |
| D. 144,865 | 5/1946 | Mason | D74/1 |
| D. 145,699 | 10/1946 | Preble, Jr. | D74/1 |
| D. 147,582 | 9/1947 | Dailey | D74/1 |
| D. 150,160 | 7/1948 | Salsbury | D58/12 |
| D. 164,733 | 10/1951 | Pretzfelder, Jr. | D74/1 |
| D. 177,224 | 3/1956 | Gershen | D74/1 |
| D. 179,091 | 10/1956 | Pangburn | D74/1 |
| D. 185,284 | 5/1959 | Hofmann | D74/1 |
| D. 187,765 | 4/1960 | Gershen | D74/1 |
| D. 188,150 | 6/1960 | Gershen | D74/1 |
| D. 190,978 | 7/1961 | Trombly, Jr. | D74/1 |
| D. 198,958 | 8/1964 | Larson | D74/1 |
| D. 202,949 | 11/1965 | Petterson | D74/1 |
| D. 207,468 | 4/1967 | Addis | D74/1 |
| D. 209,356 | 11/1967 | Le Merle | D74/1 |
| D. 226,334 | 2/1973 | Reinecke | D74/1 |
| D. 226,358 | 2/1973 | Caldwell | D74/1 |
| D. 227,175 | 6/1973 | Finkel | D74/1 B |
| D. 238,360 | 1/1976 | Gibbs | D19/69 |
| D. 239,620 | 4/1976 | Fritzinger | D19/69 |
| D. 242,452 | 11/1976 | Brown, Sr. | D19/69 |
| D. 245,914 | 9/1977 | Fritzinger | D19/69 |
| D. 259,643 | 6/1981 | Pearson | D19/69 |

(List continued on next page.)

FOREIGN PATENT DOCUMENTS 2414486 10/1974 Fed. Rep. of Germany ..... 249/102

OTHER PUBLICATIONS

Injection Molding, Clyde S. Gundermuth, Modern Plastics Encyclopedia, vol. 52, No. 10-A, 1975-1976, pp. 331, 334, 336, 339, 342, 344.

Compression Molding, Norman D. Simons, Modern Plastics Encyclopedia vol. 52, No. 10-A, 1975-1976, pp. 289-290.

Injection Molds, James R. Dreps, Modern Plastics Encyclopedia vol. 52, No. 10-A, 1975-1976, pp. 404, 406, 408.

In-Mold Decoration, Hubert G. Neumann, Modern Plastics Encyclopedia vol. 52, No. 10-A, 1975-1976, p. 448.

Injection Molds, D. E. Jay, Modern Plastics Encyclopedia vol. 53, No. 10-A, 1976-1977, pp. 402, 404, 406.

Injection Mold Temperature Control, D. W. Gerster, Modern Plastics Encyclopedia vol. 53, No. 10-A, 1976-1977, pp. 406, 408.

Transfer Molding, J. G. Fuller, Modern Plastics Encyclopedia vol. 53, No. 10-A, 1976-1977, pp. 408, 409, 412.

*Primary Examiner*—Jan H. Silbaugh

*Assistant Examiner*—Allan R. Kuhns

*Attorney, Agent, or Firm*—Body, Vickers & Daniels

[57] ABSTRACT

A method and apparatus for the manufacture of molded plastic tape dispensers are convenient and efficient for the production of a plurality of tape dispensers having both common and differing design shape portions, and enable a simplified changeover between production runs of differing designs. A stationary mold plate is adapted to releaseably receive one of a plurality of inserts having differently designed mold cavities formed therein.

1 Claim, 4 Drawing Sheets

U.S. PATENT DOCUMENTS

| | | | |
|---|---|---|---|
| 897,086 | 8/1908 | Grand . | |
| 1,837,180 | 12/1931 | Bennett, Jr. et al. . | |
| 2,145,506 | 1/1939 | De Matti | 164/45 |
| 2,262,260 | 11/1941 | Smith | 30/126 |
| 2,295,477 | 8/1942 | Jackson | 242/55.5 |
| 2,295,679 | 9/1942 | Montbach | 242/55.5 |
| 2,566,636 | 9/1951 | Renholts | 249/103 |
| 2,592,865 | 4/1952 | Corey | 164/84.5 |
| 2,607,957 | 8/1952 | Danielson et al. | 249/103 |
| 2,640,656 | 6/1953 | Donkin | 242/55.5 |
| 2,664,252 | 12/1953 | Glew | 242/55.5 |
| 2,673,042 | 3/1954 | Fritzinger | 242/55.5 |
| 2,676,658 | 4/1954 | King | 164/84.5 |
| 2,805,714 | 9/1957 | Vogt | 164/58 |
| 2,854,682 | 10/1958 | Berezny | 15/104 |
| 3,016,174 | 1/1962 | Perkins | 225/47 |
| 3,109,570 | 11/1963 | Maddalena | 225/66 |
| 3,134,526 | 5/1964 | Schleicher | 225/56 |
| 3,149,764 | 9/1964 | Waltz | 225/57 |
| 3,158,303 | 11/1964 | Pepitto | 225/66 |
| 3,159,322 | 12/1964 | Martin | 225/56 |
| 3,193,433 | 7/1965 | Tillotson | 156/527 |
| 3,417,935 | 12/1968 | Douglas et al. | 242/55.2 |
| 3,484,030 | 12/1969 | Mattheis | 325/65 |
| 3,623,643 | 11/1971 | Ikeda | 225/65 |
| 3,684,141 | 8/1972 | Hall | 225/65 |
| 3,696,980 | 10/1972 | Waltz | 225/66 |
| 3,762,261 | 10/1973 | Ekenberg | 83/649 |
| 3,871,611 | 3/1975 | Taketa | 249/102 |
| 3,970,230 | 7/1976 | Horn | 225/65 |
| 3,993,230 | 11/1976 | Oakes | 225/47 |
| 4,005,964 | 2/1977 | Bishop | 425/444 X |
| 4,009,978 | 3/1977 | Hanning | 249/68 X |

FIG. 3
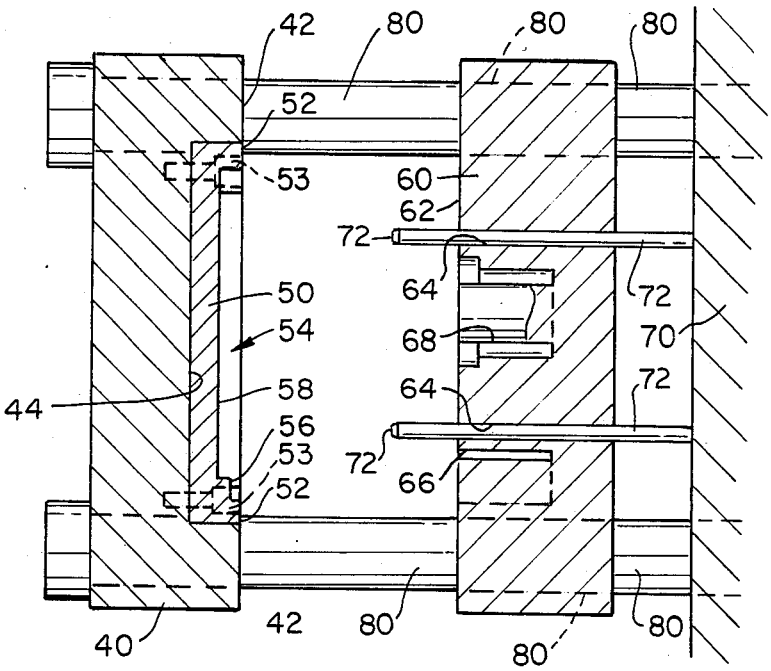
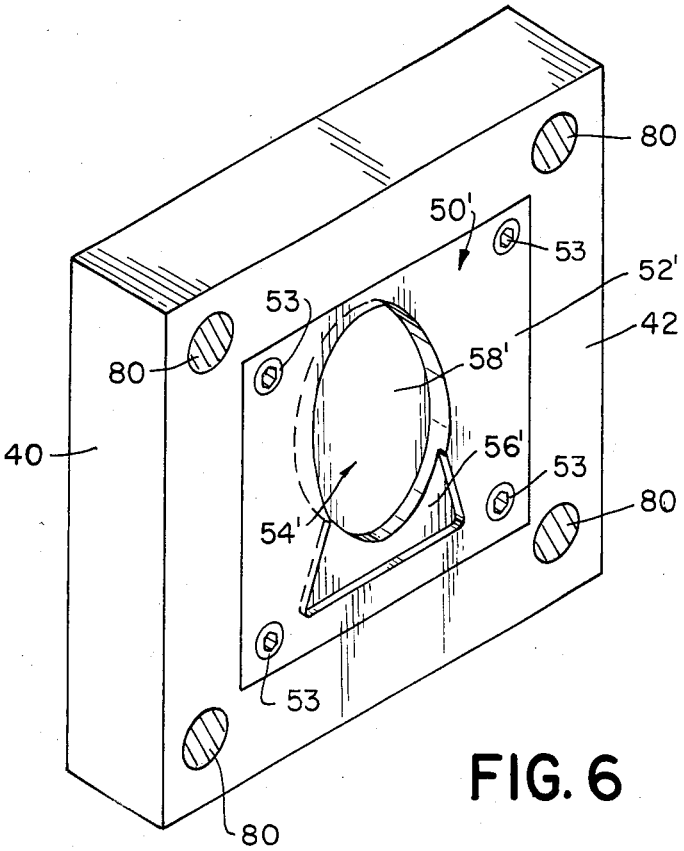
FIG. 6

APPARATUS FOR MANUFACTURING OF TAPE DISPENSER

This is a continuation-in-part of application Ser. No. 047,936 filed May 8, 1987, which application is incorporated herein by reference.

The present invention pertains to the art of tape dispensers and, more particularly, to a method and apparatus for the manufacture of ornamental tape dispensers as molded plastic articles.

BACKGROUND OF THE INVENTION

Molded plastic articles may be comprised of thermoplastic or thermosetting materials. Thermosetting materials are irreversibly chemically transformed from an initial granular state into a solid by heating in a mold. Thermoplastic materials are melted from an initial solid base and are resolidified by cooling in a mold. The mold shape is defined between open cavities formed in opposed mold plates or dies. Molding processes include compression molding and injection molding, among others.

Compression molding is a manufacturing process which can be described generally as one whereby a molded plastic article is formed from a thermosetting material. The thermosetting material is placed into an open mold which is then closed and subjected to heat and pressure. The raw material is cured under these controlled conditions to take the solid shape of the closed mold cavity. Heat may be applied by conduction, induction, or any conventional means, and pressure is applied by clamping opposed mold plates together. The finished articles are forcibly removed from the mold by ejector pins. The ejector pins may extend from an ejector plate which cooperates with a moving mold plate to push the casting out of the cavity from within when the mold plates are separated, or may be operated by a hydraulic ram or other known means coordinated with opening of the mold. Ejector pins normally leave blemishes on the product surface at the point of contact.

Injection molding is a manufacturing process whereby a thermosetting or a thermoplastic material is formed into the shape of a mold. Generally, the material is first formed into a fluid phase and is then injected under pressure into the mold. Thermosetting materials are cured to a solid phase under heat and pressure, thermoplastics are cured to a solid phase by cooling. Cooling may be accomplished by means of cooling lines extending through or around the mold.

A disadvantage common to these and other processes for manufacture of plastic castings is the expense associated with fabricating the mold plates or dies. These items must be of high quality steel in order to resist deformation throughout repeated cycles of curing temperatures and pressures. Furthermore, they are usually finely polished to produce a smooth product surface. Most importantly, the plates or dies must enable the fluid phase plastic to flow into and fill all voids in the mold cavity before it cures to a solid form. For this reason a main inlet conduit or sprue usually feeds a distribution system of runners terminating in gates through which the melt enters the mold cavity. A complex product shape may require a mold cavity to be formed with separate sections having differing outlines, depth, and surface area. Such mold cavities require a correspondingly complex arrangement of runners and gates. A deep cavity also presents a greater surface area where the cured material may stick to the cavity surface, and the mold plate must then be designed with the deep cavities more closely adapted to an ejector means. The expense of mold plates and dies can become very high whereby only a very large production run of products can be justified for each design shape.

This disadvantage of known molding methods and equipment becomes more pronounced when a series of products are to be manufactured having portions of related but differing shapes. Such products require individual plates to be fabricated for each design variation in the series. As noted above, mold plates are precisely fabricated components and must accommodate passages for cooling lines, heating lines, and other elements particular to the type of molding unit employed. Fabrication of numerous individual plates is accordingly very expensive.

Additionally, all mold plate pairs are slidably mounted on a heavy rigid frame to allow the mold to be opened and closed. For this reason changeover of mold plates is a labor intensive process causing substantial down time at the mold unit. Fabrication costs, labor costs and lost time are increased with each variation in product design shape.

The prior art is thus seen to fail to provide a cost efficient method and apparatus for the manufacture of both large and small production runs of plastic articles having related but differing design shapes.

THE INVENTION

The present invention contemplates a new and improved method and apparatus for the manufacture of molded plastic tape dispensers in a variety of different ornamental designs, with each ornamentally designed tape dispenser having common structural design components. For example, tape dispensers disclosed in copending application Ser. No. 047,936 may be manufactured in accordance with the present invention. Such tape dispensers include a base upon which the tape dispenser is supported in a free standing upright position and which includes a tape cutting edge, and a tape roll hub adapted to hold a roll of adhesive tape on the dispenser. A separate piece is provided to retain the roll on the hub. The variations in ornamental design of the tape dispensers are found in the outline shapes of a planar vertical front wall rigidly interconnecting the base with the hub. The overall shape of each tape dispenser is thus defined partly by a base and hub portion and partly by a distinct planar front wall portion. The present invention provides a molding unit which is adapted to manufacture both the commonly shaped and the differently shaped portions of the tape dispensers, as well as to accommodate all design variations of the differently shaped portions. A method is provided whereby the tape dispensers are manufactured in shapes comprised of a common and a variable portion.

In accordance with the present invention there is provided a molding unit for curing a fluid plastic material into a solid phase in the shape of a closed mold cavity. The shape of the closed mold cavity is defined in two portions, with each portion formed in one of two opposing mold plate assemblies. A movable mold plate assembly has an open cavity designed to form a commonly shaped portion of a tape dispenser. A stationary mold plate assembly has an open cavity designed to form a variably shaped portion of a tape dispenser. The stationary mold plate assembly includes a stationary mold plate having a recess designed to receive an insert. An insert is provided to fit closely within the recess and has an open cavity therein designed to form the variably shaped portion.

In accordance with one aspect of the invention, the movable mold plate cavity is formed in the shape of the base and hub portion of the tape dispenser, and the insert cavity is formed in the shape of the planar front wall portion. The base and hub portion is a more complex shape having two separate components, and is substantially deeper than the planar front wall portion. The planar front wall portion is of relatively simple and shallow configuration.

In accordance with another aspect of the invention, the stationary mold plate recess is adapted to receive any of a plurality of mold plate inserts conforming to the outline and depth of the recess. A plurality of mold plate inserts are provided, each being securely yet releaseably receivable in the stationary recess and each having an insert cavity designed to form a differently shaped planar front wall portion of a tape dispenser with all the commonly shaped base and hub portions formed in the movable mold plate cavity.

Further in accordance with the invention, a method of manufacturing the plastic tape dispensers in a mold cavity between a pair of mold plates is provided whereby the more complex and deeper portion of the tape dispenser shape is carried in the movable mold plate cavity, and the simpler, shallower portion of the overall shape is held in the stationary mold plate cavity. The molded tape dispenser is cured in the closed mold cavity between the stationary and movable mold plates, and the solid product is then ejected from the movable mold plate by ejector pins acting against the deeper, more complex portion of the product.

In accordance with another aspect of the invention, the method of manufacturing a variety of plastic tape dispensers having both common and differing design shape portions includes the steps of removing an insert from a stationary mold plate recess, replacing the removed insert with one having a differently shaped planar cavity formed therein, and closing a movable mold plate cavity against the stationary insert cavity to define a differently shaped closed mold cavity.

The principal object of the present invention is to provide a new and improved method and apparatus for the manufacture of molded plastic tape dispensers, which method and apparatus are cost efficient for the production of several models of tape dispensers each having a different ornamentally designed structural portion as well as commonly designed structural portions.

Another object of the present invention is to provide an apparatus for the manufacture of a variety of molded plastic tape dispensers each having commonly designed structural portions but also having differently designed ornamental structural portions, which apparatus accommodates all differing design portions as well as all common design portions without the need for disassembly for interchanging a mold plate or die.

Another object of the present invention is to provide a series of molding unit cavity inserts which are readily interchangeable to enable efficient changeover between production runs of molded plastic tape dispensers having differing design portions.

Still another object of the present invention is to provide a molding unit which universally accommodates differing design shapes in an ornamentally designed portion of a molded plastic tape dispenser, and which further produces the ornamental portions without blemishes normally caused by ejector pins.

Another object of the present invention is to provide a method for the changeover of a plastic molding unit from one mold cavity design to another mold cavity design without replacement of a conventional mold plate within the molding unit.

A further object of the present invention is to provide a method for changing the design of tape dispensers being manufactured as a molded plastic article by simply interchanging a mold cavity insert within a molding unit.

Further objects of the invention will become apparent from the following detailed description of a preferred embodiment thereof and from the accompanying drawings.

BRIEF DESCRIPTION OF THE DRAWINGS

In the drawings:

FIG. 3 is a cross-sectional view of a molding unit according to the present invention showing the molding unit in an open mold position;

DESCRIPTION OF A PREFERRED EMBODIMENT

Figure 1:
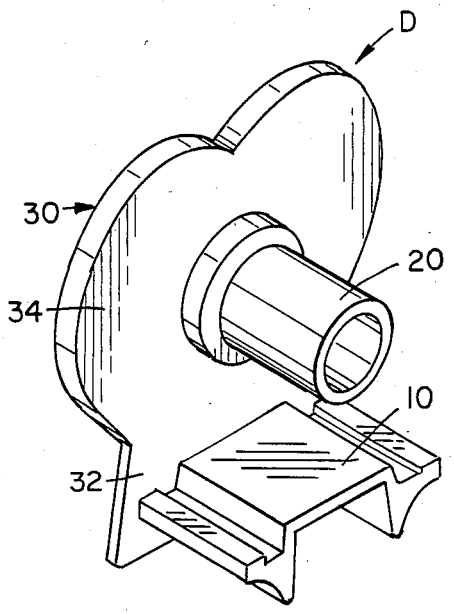
FIG. 1 is a rear pictorial view of a molded plastic tape dispenser manufactured according to the present invention.

Referring to the drawings wherein the showings are for the purpose of illustrating a preferred embodiment of the invention only and not for the purpose of limiting same, in FIG. 1 there is shown in pictorial view a molded plastic tape dispenser D as manufactured according to the present invention. Tape dispenser D is comprised of base 10, tape roll hub 20, and planar front wall 30. A separate piece, not shown, is provided to retain a tape roll on the tape roll hub. Front wall 30 comprises lower support section 32 and upper ornamental section 34. Upper ornamental section 34 is shown in FIG. 1 in the shape of a heart but can take the shape of a football, a star, or any other ornamentally shaped design. Alternately, front wall 30 may comprise a single section with an ornamental or other design shape, but tape dispensers D manufactured according to the present invention will commonly include base 10 and tape roll hub 20 as shown in FIG. 1. Accordingly, tape dispensers D manufactured, according to the present invention have an overall shape comprised of two distinct portions found on opposite sides of a plane defined by the rear surface of front wall 10. The structure and operation of the tape dispenser shown in FIG. 1 is more completely described in copending application Ser. No. 047,936, filed May 8, 1987, which is incorporated herein by reference.

Figure 2:
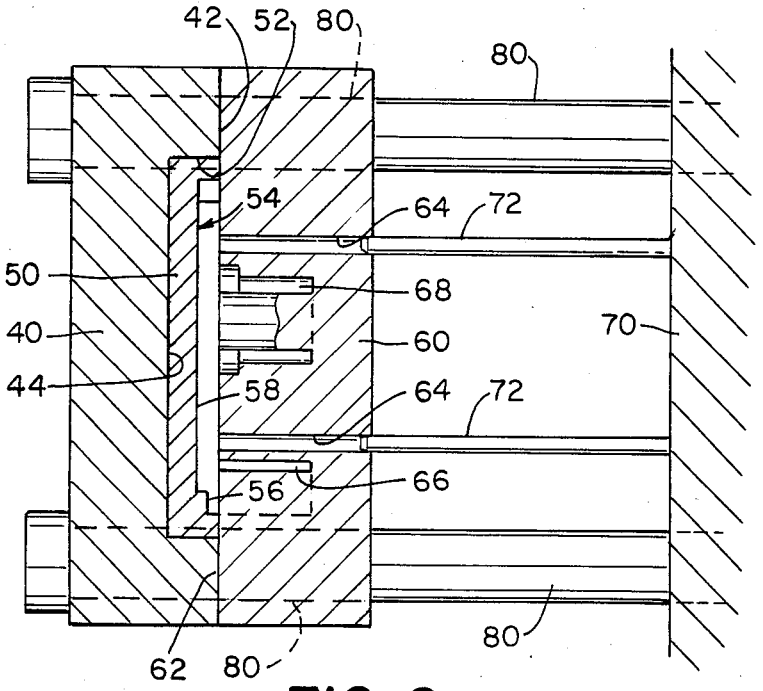
FIG. 2 is a cross-sectional view of a molding unit according to the present invention showing the molding unit in a closed mold position.

Referring now to FIG. 2, there is shown a cross-sectional view of a molding unit for manufacturing molded plastic tape dispensers such as those described above. The molding unit components shown include stationary mold plate 40, insert 50, movable mold plate 60, ejector plate 70, ejector pins 72, and sliding rods 80. It is understood that the molding unit will further comprise sprues, runners, gates, heating, cooling, venting and other standard molding unit components as are known in the art and which, for clarity of illustration, are not shown in the figures.

In the preferred embodiment stationary mold plate 40 comprises first surface 42 and recess 44. Recess 44 is a rectangular opening of uniform depth. Insert 50 is a flat plate comprising insert surface 52 and insert cavity 54. Insert 50 is closely received in recess 44 and is releaseably held therein by machine screws 53 or other suitable retaining means. Insert cavity 54 includes lower insert cavity 56 and upper insert cavity 58 respectively shaped to form lower support section 32 and upper ornamental section 34 of front wall 30 as shown in FIG. 1. Movable mold plate 60 comprises second surface 62, ejector pin passages 64 extending therethrough, base cavity 66 and hub cavity 68. Base cavity 66 and hub cavity 68 are respectively shaped to form base 10 and tape roll hub 20 as shown in FIG. 1. An ejector means is provided in the form of ejector plate 70 having ejector pins 72 extending away therefrom into ejector pin passages 64 formed through movable mold plate 60. Sliding rods 80 extend from stationary mold plate 40 to ejector plate 70 through movable mold plate 60. Movable mold plate 60 is slidable on slide rods 80 between a closed mold position shown in FIG. 2 and an open mold position shown in FIG. 3.

Figure 4:
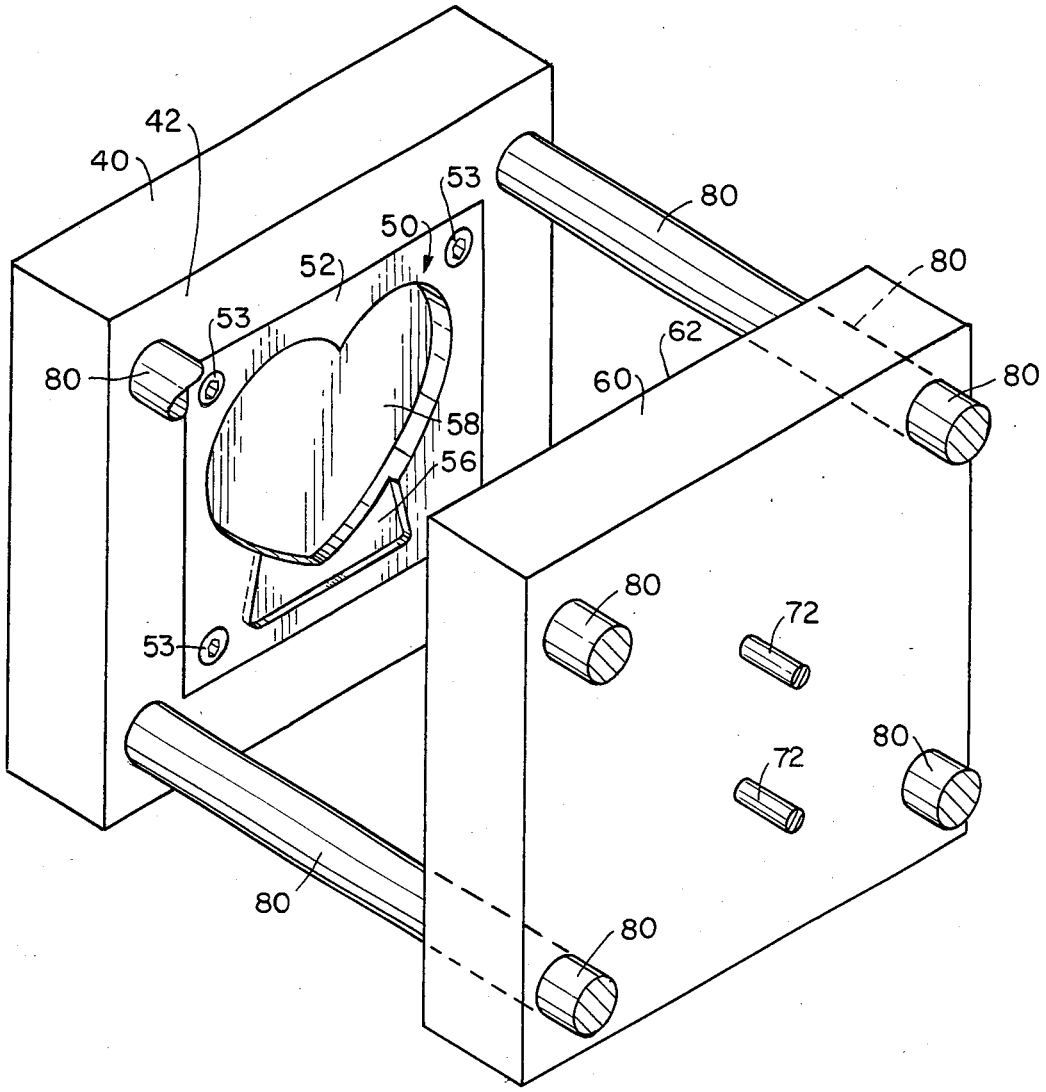
FIG. 4 is a partial pictorial view of the molding unit shown in FIG. 3.

Referring now to FIG. 4, there is shown a pictorial view of the molding unit shown in FIGS. 2 and 3 with insert 50 closely yet releasably received within recess 44 as described above. More specifically, insert 50 has a rectangular shape closely matched with the shape of recess 44 to be received therein without the need for manual positioning. Non-rectangular shapes may of course be used as long as the insert fits in a single, stationary position between the sides of the recess. Also, insert surface 52 is flush with first surface 42 to provide a single planar surface across the stationary mold plate.

As shown in FIG. 4, lower and upper insert cavities 56 and 58 are designed to provide the front portion of the molded plastic tape dispenser shown in FIG. 1. Since planar front wall 30 of tape dispenser D is relatively shallow as compared to base 10 and hub 20, insert cavity 54 is the shallower of the opposed portions of the closed mold cavity shown in FIG. 2. For this reason there is a lesser tendency for the cured plastic material to stick to the interior of insert cavity 54. Consequently, there is no need to equip stationary mold plate 40 or insert 50 with ejector pins or other forcible product ejection means. In addition to simplifying the structural details of stationary mold plate 40 and insert 50, this arrangement insures that the ornamental front face of wall 30 will be free of blemishes otherwise caused by impact of ejector pins.

Figure 5:
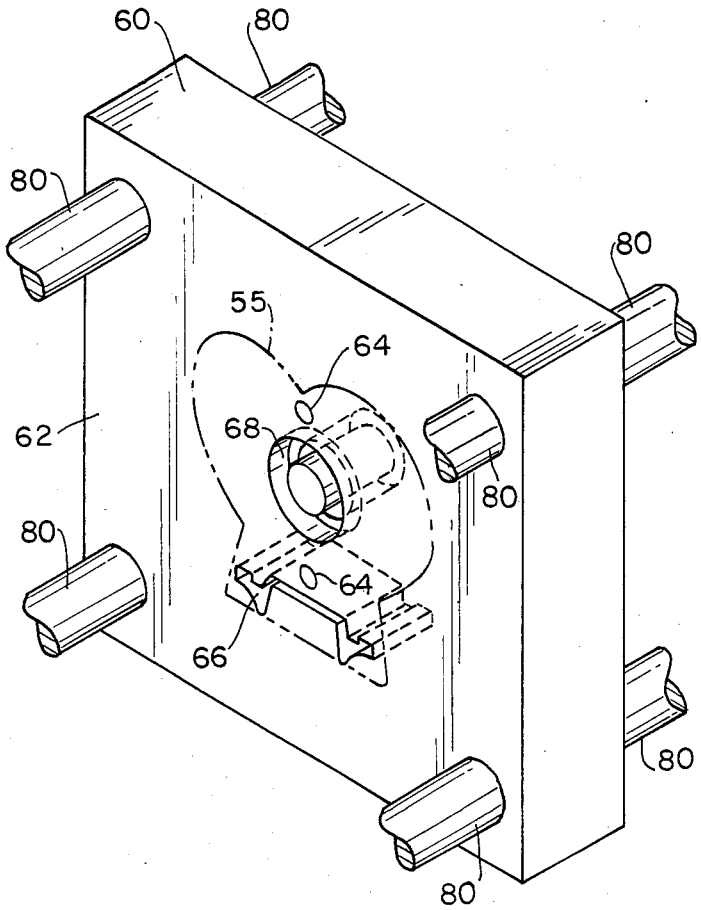
FIG. 5 is a partial pictorial view of a component of the molding unit shown in FIG. 4: and, FIG. 6 is a pictorial view of an alternate embodiment of a component of the molding unit shown in FIG. 4.

In FIG. 5 there is shown a pictorial view of movable mold plate 60 with base cavity 66 and hub cavity 68 formed therein to provide the rear portion of the molded plastic tape dispenser shown in FIG. 1. Base cavity 66 and hub cavity 68 are deeper and more complex than insert cavity 54, whereby there is a greater tendency for the cured plastic material to adhere to the movable mold plate than to the stationary plate holding shallow, planar insert 54. For this reason, ejector pin passages 64 are provided through movable mold plate 60. Alternate ejector pin passages may be provided to direct ejector pins into base cavity 66 and hub cavity 68 to eject the solid base and hub directly from the deepest parts of the cavities.

FIG. 5 further illustrates in phantom view the outline 55 of insert cavity 54 superimposed over second surface 62 and surrounding the opposed cavities 66 and 68 as disposed when the molding unit takes the closed mold position shown in FIG. 2. Outline 55 of insert cavity 54 completely surrounds base cavity 66 and hub cavity 68 on second surface 62 such that the tape dispenser components found at the rear of front wall 30 will lie entirely within the periphery of front wall 30.

In FIG. 6 there is shown an alternate embodiment 50' of insert 50. Insert 50' fits closely within recess 44 in the same manner as insert 50 described above. Insert 50' comprises alternate insert cavity 54' with alternate lower and upper insert cavities 56' and 58'. Alternate lower insert cavity 56' is similar in outline and depth to lower insert cavity 56, but alternate upper insert cavity 58' differs from upper insert cavity 58 in outline and depth. It is intended that a plurality of alternate embodiments of insert 50 be provided, all of which will be receivable into recess 44 as shown in FIGS. 4 and 6, and each of which will have differing design details at the insert cavity. Inserts 50 and 50' are composed of substantially less material than stationary mold plate 40, and do not require the fabrication details found in stationary mold plate 40 to accommodate molding unit sliding rods or other conventional molding unit processing elements such as heating or cooling lines. Furthermore, inserts 50 and 50' do not require the fabrication details found at movable mold plate cavities 56 and 58 such as ejector pin passages.

In operation, the molding unit components shown in FIGS. 2 and 3 will produce the molded plastic tape dispenser shown in FIG. 1, and others, in accordance with the invention. Movable mold plate 60 is slidably moved into the closed mold position with second surface 62 abutting in flush contact with first surface 42 and insert surface 52. In conventional manner fluid plastic is forced through a sprue and runners, not shown, into the closed cavity consisting of lower and upper insert cavities 56 and 58, base cavity 66 and hub cavity 68. The plastic is then caused to cure to a solid phase. The mold is opened with movable mold plate 60 moving away from stationary mold plate 40 and toward ejector plate 70 on sliding rods 80. Movable mold plate 60 will progress toward ejector plate 70 at least until ejector pins 72 extend through ejector pin passages 64 to reach and protrude beyond second surface 62, whereupon the solid plastic product will be forced out of the deep mold cavities in which it may have adhered. Blemishes caused by ejector pins 72 will appear only at the rear surface of ornamentally designed front wall 30. Alternately, ejector pin passages 64 may extend into movable mold plate cavities 66 and 68 to directly eject the deepest portions of the solid plastic base and hub, whereby blemishes caused by ejector pins 62 will appear on these non-ornamentally designed components. In either embodiment, a molded plastic tape dispenser is manufactured without blemishes on the front face.

When a tape dispenser is to be manufactured with a differently shaped ornamental front wall, insert 50 is removed from recess 44 and, for example, insert 50' is substituted therefor. The molding unit is thereby adapted to produce alternately ornamental tape dispensers having base 10 and tape roll hub 20 without removing the mold plates and ejector plate from the sliding rods as would otherwise be necessary to permit substitution of an alternate stationary mold plate. A single stationary mold plate 40 accommodating different inserts 50, 50' is retained within the molding unit throughout the manufacture of all varieties of tape dispensers D.

The invention has been described with reference to the preferred embodiment. Obviously modifications and alterations will occur to others upon the reading and understanding of this specification. It is intended to include all such modifications and alterations insofar as they come within the scope of the appended claims or equivalents thereof.

Having thus described the invention, it is claimed:

1. An apparatus for the manufacture of one of a plurality of molded plastic tape dispensers in a unitary piece formed in a closed mold cavity defined between two opposing mold plates, said plurality of tape dispensers having differing design shape portions, each of said differing design shape portions having a generally planar shape and a peripheral edge, and further having common design shape portions comprising a base upon which said tape dispensers stand upright, a tape roll hub and a tape cutting edge, said common design shape portions all being spaced inwardly from the peripheral edges of said planar shaped portions, said apparatus comprising:

ejector pins associated with said closed mold cavity;

a first of said opposing mold plates having a generally planar surface surrounding surfaces defining first cavities in said first mold plate, said cavities adapted to form said base, said tape roll hub, and said cutting edge, said generally planar surface being adapted to form a rear surface of one of said generally planar shapes and having apertures adapted for extension of said ejector pins outwardly therefrom against said rear surface;

a second of said opposing mold plates having a surface with a recess defined therein; and, an insert adapted to be closely and releasably received in said recess, said insert having a peripheral surface surrounding a surface defining a second cavity in said insert, said second cavity being defined by a surface adapted to form a front surface of one of said generally planar shapes and by a peripheral cavity edge, said peripheral cavity edge corresponding to said peripheral edge of said generally planar shape and being adapted to surround said first cavity and said apertures at said surface of said first mold plate with said peripheral surface of said insert in contact with said generally planar surface of said first mold plate.

* * * * *